US009366136B2

(12) United States Patent
Wingeier et al.

(10) Patent No.: US 9,366,136 B2
(45) Date of Patent: Jun. 14, 2016

(54) DEVICE FOR COATING TUNNEL WALLS

(75) Inventors: Lars Wingeier, Suezach (CH); Otto Tschumi, Frauenfeld (CH)

(73) Assignee: Atlas Copco Rock Drills AB, Örebro (SE)

( * ) Notice: Subject to any disclaimer, the term of this patent is extended or adjusted under 35 U.S.C. 154(b) by 2701 days.

(21) Appl. No.: 10/593,001

(22) PCT Filed: Feb. 17, 2005

(86) PCT No.: PCT/EP2005/001608

§ 371 (c)(1),
(2), (4) Date: Jul. 22, 2008

(87) PCT Pub. No.: WO2005/095759

PCT Pub. Date: Oct. 13, 2005

(65) Prior Publication Data

US 2008/0317952 A1 Dec. 25, 2008

(30) Foreign Application Priority Data

Mar. 16, 2004 (DE) ..... 10 2004 012 998

(51) Int. Cl.
*B05B 1/20* (2006.01)
*E21D 11/10* (2006.01)

(52) U.S. Cl.
CPC ..... *E21D 11/105* (2013.01)

(58) Field of Classification Search
CPC ..... E21D 11/105
USPC ..... 239/159, 160, 164, 165, 166, 169, 172, 239/175; 169/24
See application file for complete search history.

(56) References Cited

U.S. PATENT DOCUMENTS 3,224,203 A * 12/1965 Brannfors et al. ..... 405/150.2
3,531,054 A 9/1970 Pulk
4,156,503 A 5/1979 Noren
4,288,196 A * 9/1981 Sutton, II ..... 414/699
5,788,158 A * 8/1998 Relyea ..... 239/166
5,851,580 A * 12/1998 Amberg et al. ..... 427/8

FOREIGN PATENT DOCUMENTS

DE 2361968 6/1975

OTHER PUBLICATIONS

Patent Abstract of Japan, Publication No. 2000-220393, Date of Publication of Application Aug. 8, 2000, Inventor Yamano, Kanichiro, et al.
Derwent Patent Abstract for Patent DE 2361968, WPI ACC No. 1975-G6744W Jun. 19, 1975/.

(Continued)

*Primary Examiner* — Jason Boeckmann
(74) *Attorney, Agent, or Firm* — Curatolo Sidoti Co., LPA; Joseph G. Curatolo; Salvatore A. Sidoti

(57) ABSTRACT

The invention relates to an apparatus for coating the inner surface of a tunnel section with sprayed concrete, comprising a spray lance b) (4) and a spray nozzle a) (7) which can each be moved in all directions by means of joints, a first control device k) for the operation of the spray lance b) (4) and a second control device l) for the operation of the spray nozzle a) (7) being provided.

7 Claims, 4 Drawing Sheets

(56) References Cited

OTHER PUBLICATIONS

Figure 1:
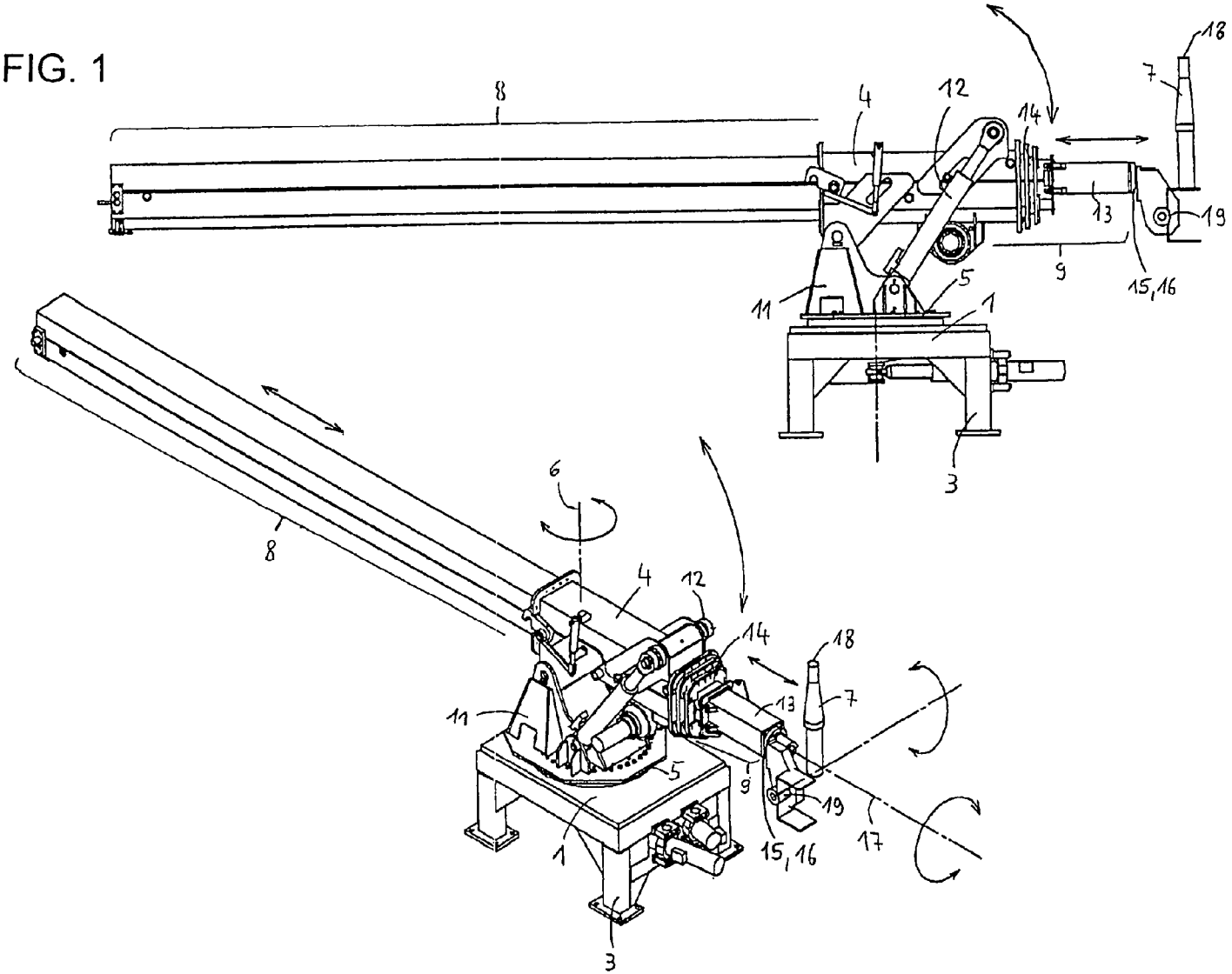

Cheng, M.Y., et al., Technological enhancement and creation of a computer-aided construction system for the shotcreting robot, Automation in Construction vol. 10 (2001) p. 517-526, May 1, 2001, Elsevier Science Publishers, Amsterdam, NL; XP004229840; Compendex E 2001385595211.

Office Action, Corresponding European Patent Application No. 05-707,455.1 (Oct. 15, 2009).

* cited by examiner

DEVICE FOR COATING TUNNEL WALLS

CROSS REFERENCE TO RELATED APPLICATIONS

This application is a national stage application of International Application No. PCT/EP2005/001608, filed 17 Feb. 2005, which claims the benefit of Application No. DE 10 2004 012 998.3, filed 16 Mar. 2004, from which applications priority is claimed.

The invention relates to an apparatus for coating the inner surface of a tunnel section, to a vehicle, to a method of coating the inner surface of a tunnel section and to the use of the apparatus.

In order to secure the rock of a tunnel void, in order to form a lining layer and also for insulation purposes, a sprayed concrete layer is normally applied to the inner wall of a tunnel under construction. In this case, a tunnel void is understood to mean the free space which is broken out of a rock by blasting or cutting. The length of the void in this case depends, inter alia, on the quality of the stone. Conventional void lengths in tunnel and gallery construction lie between 1 and 6 meters.

Equipment for spraying concrete is known which is used both in tunnel and gallery construction and also for securing excavations and embankments. One known item of equipment has a spraying robot which is constructed on a carrying vehicle and which is used substantially to mechanize the guidance of the spray nozzle used for spraying the concrete as the sprayed concrete is applied to the surface to be treated and, as a result, to improve the working safety and the working conditions for the construction workers.

An item of equipment of this type preferably has a carrying arm which can move horizontally and vertically and a spray nozzle which is fixed to the latter, can be extended and can likewise move freely and which, at its one end, carries a spray nozzle connected to a concrete delivery line and used for spraying the concrete. The said nozzle is in this case fixed to a rotary head which can be moved about the axis of the spray lance, so that the axis of the concrete jet emerging from the spray nozzle can always be kept at an optimum angle with respect to the surface during the spraying process. The control of all the movable elements of the spraying robot is carried out with a remote control, it being possible for routine movements, such as the horizontal movement of the spray lance, to be automated.

Various properties of a concrete layer applied to the inner surface of a tunnel or gallery, such as the compressive strength and the adhesive properties, for example, depend to a great extent on the spraying angle and the spraying distance. It is known that optimum coating is carried out when the distance of the spray nozzle from the wall—depending on the type of stone—is preferably 1 to 2 meters and the axis of the concrete jet emerging from the spray nozzle is as perpendicular as possible to the tunnel wall. If these method parameters are not maintained, the proportion of material which bounces back is disproportionately high. In this case, material which bounces back is understood to mean that quantity of sprayed material which does not remain adhering to the wall and is therefore left unused. As a result of sprayed concrete bouncing back, in addition to the costs for the sprayed concrete which cannot be used, higher operating costs arise, caused by material wear and material disposal. Added to this is the fact that, if the aforementioned method parameters are not maintained, the amount of concrete actually remaining on the inner wall of the tunnel after a spraying process can no longer be determined because of the amount of material which has bounced back, which can be determined only in a complicated manner and is therefore normally unknown.

A tunnel wall to be coated with sprayed concrete generally has a very irregular composition. A substantial disadvantage of the equipment described above therefore consists in the fact that it is not always simple to align the spray nozzle exactly perpendicular to the surface of the rock and to maintain an ideal distance from the latter. Furthermore, the wall thickness of a concrete layer applied with the known equipment can no longer be determined, because of the normally irregular tunnel wall and the material wear which, under certain circumstances, is high.

Finally, the control of the spray lance and the optimum adjustment of the rotary head require relatively many cumbersome and time-consuming operations, which in practical terms can be carried out only with the cooperation of at least one person.

U.S. Pat. No. 5,851,580 describes a method in which the application of the sprayed concrete to the surface of the tunnel is monitored by an automatic control system. An automatic control system of this type necessitates complicated technology, so that the corresponding coating apparatus is complicated and therefore uneconomic. This can be attributed, inter alia, to the fact that appropriate apparatuses generally have a high number of joints (at least 7) and all the joints have to be provided with measuring systems and controllers.

It is an object of the present invention to provide an apparatus for coating inner surfaces of tunnels with which sprayed concrete can be applied uniformly and with little loss of material, the intention being for the apparatus to be economical to purchase and to operate.

The achievement of this object is based on an apparatus for coating the inner surface of a tunnel section with sprayed concrete comprising a) a spray nozzle,
b) a spray lance at whose one end the spray nozzle a) is arranged,
c) a carrier, on which the spray lance b) is fixed and
d) a connection point for a connecting line for the delivery of sprayed concrete, which is preferably located on the spray nozzle a), it being possible for the spray lance b) and the spray nozzle a) in each case to be moved by means of joints.

The achievement of this object according to the invention is characterized in that there are e) a joint which connects the carrier c) and the spray lance b) to each other and mounts the spray lance b) in such a way that the spray lance b) can be moved in rotation about the vertical axis,
f) a joint via which a segment of the spray lance b) that faces the spray nozzle a) can be raised upwards and lowered downwards,
g) a joint via which the segment of the spray lance b) that faces the spray nozzle a) can be lengthened or shortened telescopically,
h) a joint via which the spray nozzle a) can be moved in rotation about the longitudinal axis of the segment of the spray lance that faces the spray nozzle a), and
i) a joint via which the spray nozzle a) can be moved in such a way that the outlet opening of the spray nozzle a) can be brought close to or away from the longitudinal axis of the segment of the spray lance b) that faces the spray nozzle a), a control device k), with which the movement of the spray lance b) can be directed via the joints e), f) and g), and a control device l), with which the movements of the spray nozzle a) can be directed via the joints h) and i), are provided.

According to the definition, a tunnel section is also to be understood to mean the section of a cavity which is not referred to as a tunnel in normal everyday language, for example a mine or an excavation.

It is important that the control device k) and the control device l) operate independently of each other or can be operated independently of each other. However, it is possible for the control device k) and the control device l) to be arranged beside each other on a common operating device.

It is advantageous that the apparatus according to the invention has only five joints and, as a result, can be controlled relatively easily. This low number of joints also necessitates a comparatively simple construction, as a result of which the spraying apparatus according to the invention becomes particularly economic. The assignment according to the invention of the joints to two control devices that operate separately from each other ensures an ability to be operated comparatively easily. In spite of this ability to be operated easily and the high economy, the apparatus according to the invention ensures a uniform application of the sprayed concrete, specifically with a low loss of material.

In a preferred embodiment of the invention, the control device k) and the control device l) can in each case be operated manually, without computer assistance, with the aid of two joysticks, one joystick belonging exclusively to the control device k) and the other joystick belonging exclusively to the control device l). The two joysticks are expediently arranged on a common operating device, such as a remote control device.

As a result of dispensing with the computer assistance, this embodiment of the invention ensures a low purchase price of the apparatus according to the invention. However, because of the low number of joints and the control system according to the invention, the ability to be operated comparatively easily is provided in spite of the lack of computer assistance.

In a further preferred embodiment of the invention, the control device k) is computer-operated and the control device l) can be directed manually, without computer assistance, with the aid of a joystick. This variant ensures the ability to be operated even more simply as compared with the embodiment described previously.

The segment of the spray lance b) that faces the spray nozzle a) or at least one section of the segment of the spray lance b) that faces the spray nozzle a) is expediently formed as a telescopic arm.

A segment of the spray lance b) that faces away from the spray nozzle a) can preferably be extended in the direction of the spray nozzle a), so that, by means of appropriate extension and retraction, the distance between carrier c) and spray nozzle a) can be varied, provision being made that, during operation, the segment of the spray lance b) that faces away from the spray nozzle a) is fixed in an extended position and, during transport and parking, the segment of the spray lance b) that faces away from the spray nozzle a) is fixed in a correspondingly retracted position, in which the distance between carrier c) and spray nozzle a) is relatively small. This ensures that the apparatus according to the invention can be transported easily and needs a comparatively small parking space. In addition, this technique makes it possible for there to be a large distance between spray nozzle a) and carrier during operation.

As a rule, the apparatus according to the invention is arranged on a mobile chassis. This can be located, for example, on a heavy goods vehicle. The present invention thus also relates to a vehicle, preferably present as a heavy goods vehicle, which has the apparatus described above.

Furthermore, the invention relates to a method of coating the inner surface of a tunnel section with sprayed concrete with the aid of the apparatus described above, the spray nozzle being kept at a distance of 1 to 3 meters at right angles to the inner wall of the tunnel during the spraying process. This ensures that the proportion of material bouncing back is relatively low and the application is carried out uniformly.

Finally, the invention also relates to the use of an apparatus described above for the production of coatings in tunnel and mine construction.

Figure 2A:
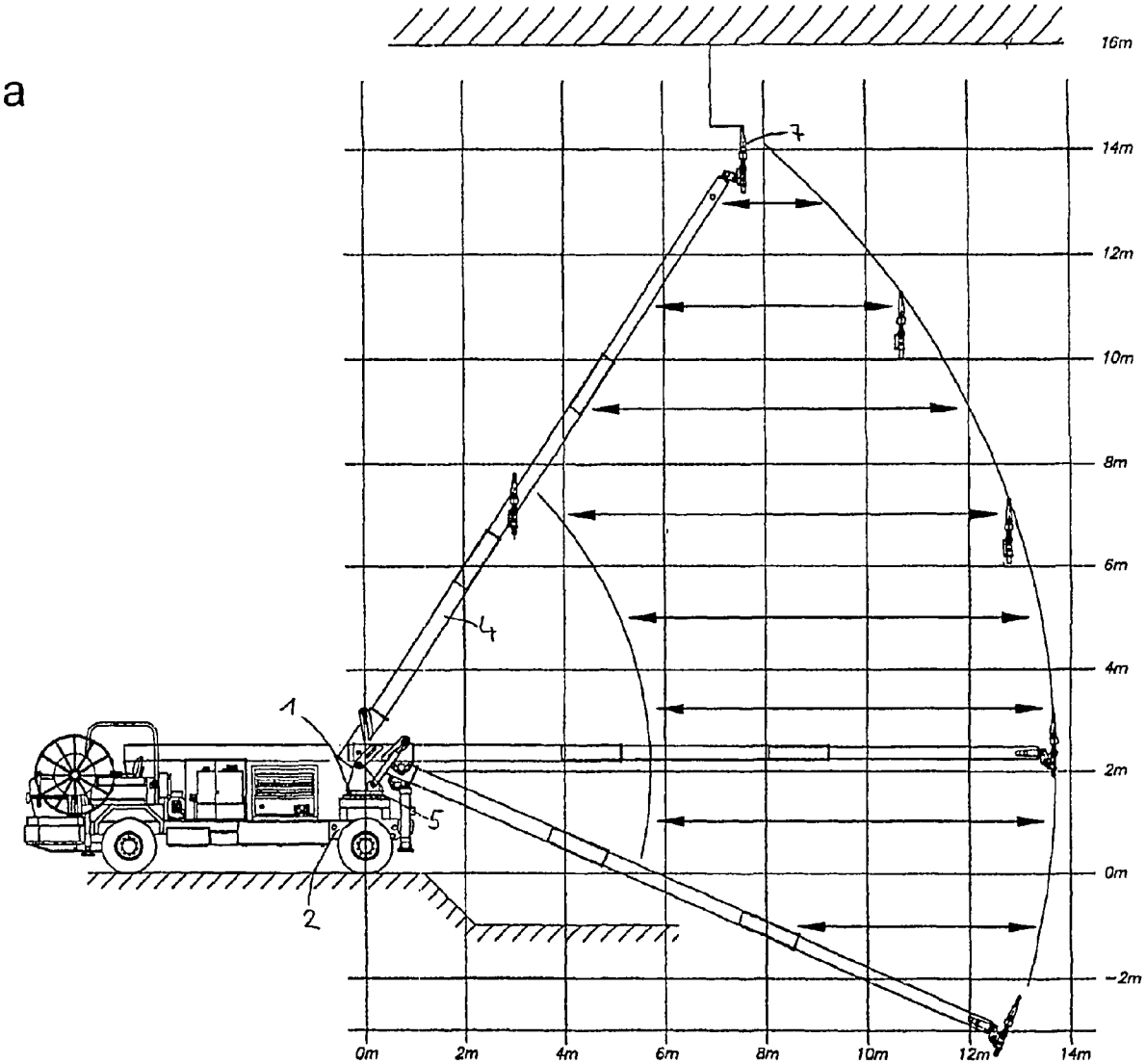
Figure 2B:
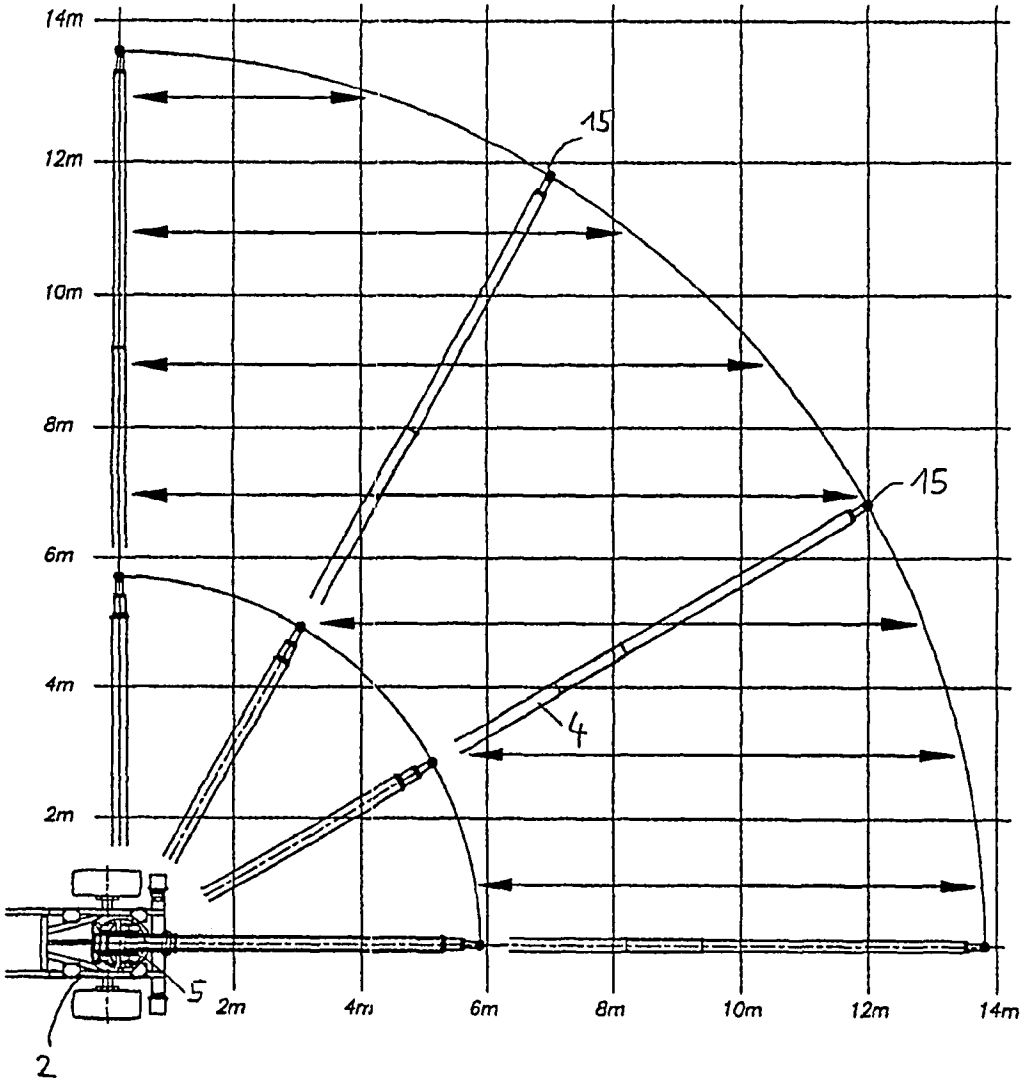
Figure 3:
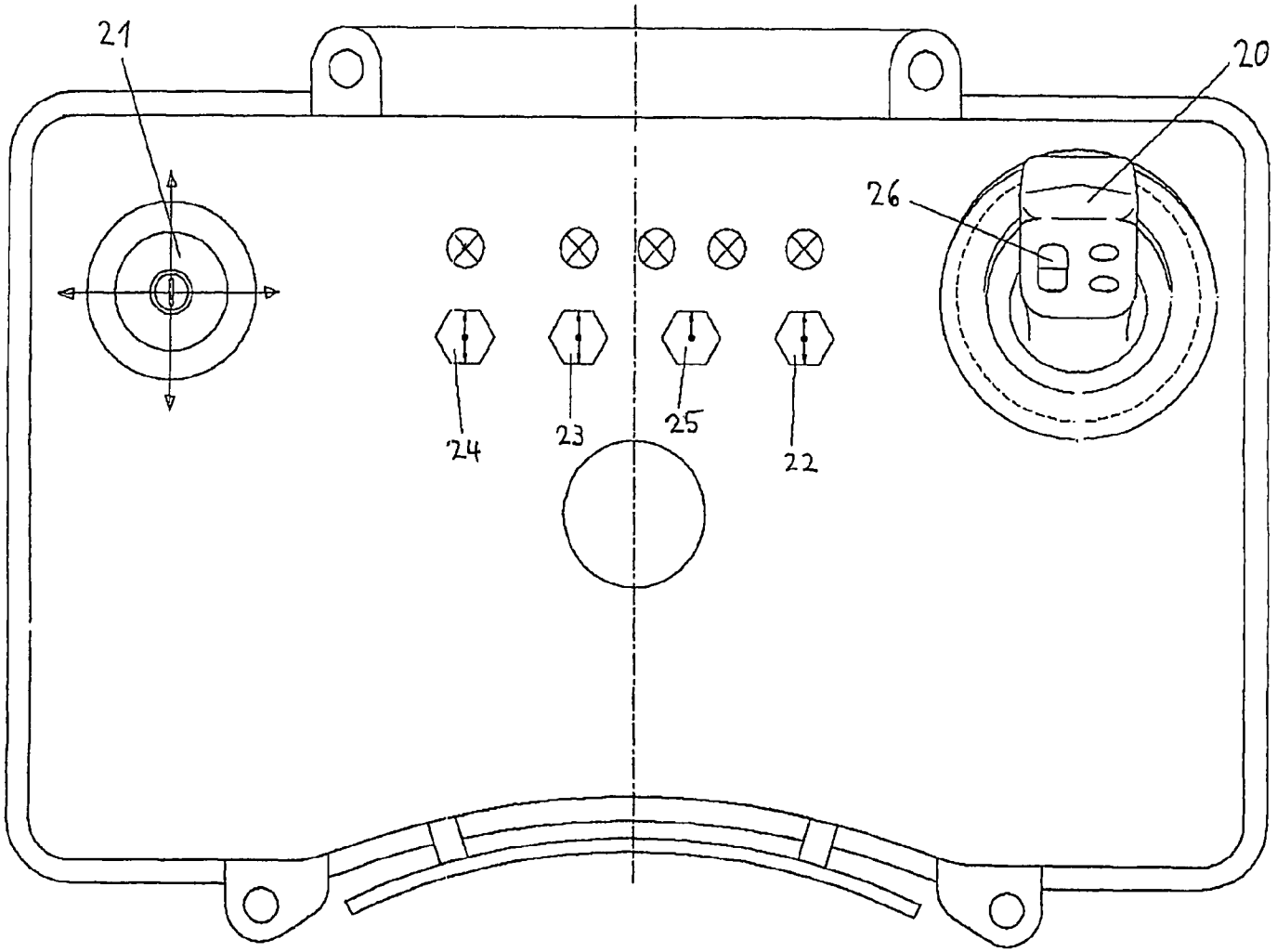

In the following text, the invention will be explained in more detail using the drawing, in which:

FIG. 1 shows an illustration which illustrates the basic construction and the mechanical functional principle of an apparatus according to the invention in a cross-sectional view and in an oblique view, FIG. 2*a* shows a cross-sectional depiction of a vehicle according to the invention, which illustrates the functioning of the apparatus according to the invention schematically, FIG. 2*b* shows a depiction in the form of a plan view which illustrates the functioning of the apparatus according to the invention, and FIG. 3 shows a schematic diagram of an operating device for the operation of the apparatus according to the invention, in which both the control device k) and the control device l) can be directed manually without computer assistance.

The apparatus according to the invention shown in FIG. 1 has, in the lower region, a carrier c), which is connected via feet 3 to a mobile chassis 2, not illustrated in FIG. 1. In the upper region, the carrier c) 1 is connected via a joint to the spray lance b) 4, the spray lance b) 4 being mounted by means of the joint e) 5 in such a way that the spray lance b) 4 can be moved in rotation about the vertical axis 6. The spray lance b) 4 arranged above the carrier c) 1 has, at one end, a spray nozzle a) 7 and is divided into a segment 8 that faces away from the spray nozzle a) and into a segment 9 that faces the spray nozzle a). The entire spray lance b) 4 is connected to the upper, rotatable region of the carrier c) 1 (rotary head) via a joint f) 12 in such a way that the segment 9 of the spray lance b) 4 that faces the spray nozzle a) can be raised upwards and lowered downwards. The segment 9 of the spray lance b) 4 that faces the spray nozzle a) is partly formed as a telescopic arm 13, so that the segment 9 of the spray lance b) 4 that faces the spray nozzle a) can be lengthened or shortened telescopically via the joint g) 14. The segment 8 of the spray lance b) 4 that faces away from the spray nozzle a) can be extended in the direction of the spray nozzle a) 7, so that, by means of appropriate extension and retraction, the distance between carrier c) 1 and spray nozzle a) 7 can be varied. The joints e) 5, f) 12 and g) 14 can in each case be equipped with a distance measuring system, which contribute to the semiautomatic control. Provision is made is that, during operation, the segment 8 of the spray lance b) 4 that faces away from the spray nozzle a) is fixed in an extended position and, during transport and parking, the segment 8 of the spray lance b) 4 that faces away from the spray nozzle a) is fixed in a correspondingly retracted position, in which the distance between carrier c) 1 and spray nozzle a) 7 is comparatively small. The apparatus shown in FIG. 1 is in this parking position. The spray nozzle a) 7 is connected to the end of the telescopic arm 13 via a joint h) 16 at the fixing point of the spray head (TCP) 15. Via this joint h) 16, the spray nozzle a) 7 can be moved in rotation about the longitudinal axis 17 of the segment 9 of the spray lance b) 4 that faces the spray nozzle a). Between this joint h) 16 and the spray nozzle a) 7 there is a further joint i) 19, via which the spray nozzle a) 7 can be moved in such a way that the outlet opening 18 of the spray nozzle a) 7 can be brought close to or away from the longitudinal axis 17 of the segment 9 of the spray lance b) 4 that faces the spray nozzle a). On the spray nozzle a) 7 there is a connection point, not shown, for a connecting line for the delivery of sprayed concrete.

FIG. 2 shows an apparatus according to the invention which is mounted on a special heavy goods vehicle. The spray lance b) 4 is in the extended state (operating position). Because of the high torque which is caused by the extended spray lance b) 4, the vehicle has special supports which can be extended for securing support before and during operation.

FIG. 2*a* shows, schematically, the movements of the spray lance b) 4 which have to be carried out in order to guide the spray nozzle a) 7 along the inner wall of the tunnel in the plane which is formed by the vertical and the longitudinal axis 17 of the vehicle. These movements of the spray lance b) 4 may be controlled exclusively by the joints f) 12 and g) 14, by the angle of the spray lance b) 4 with respect to the vertical being varied via the joint f) 12 and, via the joint h) 16, by varying the length of the segment 9 of the spray lance b) 4 that faces the spray nozzle a) 7, the desired distance from the inner surface of the tunnel being maintained. If the spray nozzle a) 7 is to be moved out of the aforementioned plane, the "rotary tower" must be moved via the joint e) 5. The movements which the spray nozzle a) 7 completes along the arrows shown in FIG. 2*a* are thus controlled exclusively via the joints f) 12 and g) 14.

FIG. 2*b* illustrates how the spray nozzle a) 7 is guided at a constant distance along the inner surface of the tunnel in a plane which is formed by the longitudinal axis 17 of the vehicle and the horizontal. Movements which the spray lance b) 4 completes parallel to the longitudinal axis 17 of the vehicle and in the last-named plane—in accordance with the arrows shown in FIG. 2*b*—are controlled exclusively via the joints e) 5 and g) 14. For these movements, only the joints e) and g) are thus actuated, the angle with respect to the longitudinal axis 17 of the vehicle being varied via the joint e) 5, and the length of the segment 9 of the spray lance b) 4 that faces the spray nozzle a) being varied via the joint g) 14 in such a way that a constant distance from the inner surface of the tunnel is approximately maintained. Movements which are completed out of this plane are controlled via the joint f) 12.

Via the joints h) 16 and i) 19, the outlet opening 18 of the spray nozzle a) 7 is kept perpendicular to the inner surface of the tunnel during operation.

The remote control device, illustrated in FIG. 3, of an apparatus according to the invention shows a large joystick 20 for the control of the movements of the spray lance b) 4 via the joints e), f) 12 and g) 14, a small joystick 21 for the control of the spray nozzle a) 7 via the joints h) 16 and i) 19, a control key 22 for the supply of sprayed concrete, a control key 23 for changing over the operating mode from semiautomatic to manual, a control key 24 for extending and retracting the part segment of the spray lance b) 4 that faces away from the spray nozzle a) 7, in order to set the parking and operating position of the apparatus according to the invention, a control key 25 with which, in computer-assisted operation, movement sequences of the TCP 15 (fixing point of the spray head) can be stored or pre-programmed (see below), and a rocker 26, with which the execution of the stored or pre-programmed movements can be controlled in computer-assisted operation.

In the operating mode "manual operation without computer assistance", computer and distance measuring system are not active. The two joysticks drive valve boosters of hydraulic valves directly.

The movement predefinitions by means of the large joystick 20 are then as follows:

Lever to right/left=joint e) 5; rotate to right/left

Lever to front/rear=joint f) 12; raise/lower the segment 9 of the spray lance b) 4 that faces the spray nozzle a)

Rocker 26 up/down=not effective—no movement pre-definition is made

The movement pre-definitions by means of the small joystick 21 are as follows:

Lever to right/left=joint h) 16; rotate spray nozzle a) 7 to right/left

Lever to front/rear=joint i) 19; tilt spray nozzle a) 7 forward/back

During manual operation with computer assistance (semi-automatic operation), the computer and the distance measuring systems in the joints e) 5, f) 12 and g) 14 come into use. With the aid of the rocker 26, the movements of the TPC 15 in computer-assisted operation are predefined as follows:

Rocker up/down=TPC is moved forward/backwards in accordance with the arrows illustrated in FIGS. 2*a*, 2*b*.

The computer assistance ensures that the TCP 15 is guided in parallel with a "teach-in" straight line defined in space. The TCP 15 completes a linear movement along a previously defined straight line, which can be in accordance with the arrows in FIGS. 2*a* and 2*b*. The straight line is defined by the operator in a "teach-in mode" by means of moving to the first and last points of the straight line. This is done by the operator moving manually to the first point, which is defined by the spatial coordinates x1, y1, z1, and causing this to be registered by pressing a knob. At another point in space, a second point x2, y2, z2 is moved to and registered in the same way. The above-described storage of a straight line, specifically by programming in a first and second point, is carried out with the aid of the control key 25. If the rocker 26 of the large joystick 20 is moved, then the TCP 15 is moved forwards and backwards accordingly, specifically along the previously defined straight line. All other parallel straight lines are then selected by means of the large joystick 20. Care must be taken that that the y and z coordinates are not simply kept constant when moving forwards and backwards but that the further movements are carried out in parallel with the previously defined straight line. In other words, it is possible to state that, once the straight line has initially been determined, the operator can carry out the spraying work in such a way that the spray lance b) 4, viewed in three dimensions, is moved up/down or left/right, the spray nozzle a) 7 in the process completing movements parallel to the previously defined straight lines, which are in accordance with the arrows in FIGS. 2*a, b*.

The invention claimed is:

1. An apparatus for coating the inner surface of a tunnel section with sprayed concrete comprising a) a spray nozzle having an outlet opening, b) a spray lance at which one end the spray nozzle is arranged, c) a carrier, on which the spray lance is fixed, d) a connection point for a connecting line for the delivery of sprayed concrete, located on the spray nozzle, the spray lance and the spray nozzle in each case being capable of being moved by means of joints, wherein there are e) a first joint having a vertical axis which connects the carrier and the spray lance to each other and which mounts the spray lance in such a way that the spray lance can be moved in rotation about the vertical axis, f) a second joint via which a segment of the spray lance that faces the spray nozzle can be raised and lowered, g) a third joint via which the segment of the spray lance that faces the spray nozzle can be lengthened or shortened telescopically, the segment of the spray lance that faces the spray nozzle having a longitudinal axis, h) a fourth joint via which the spray nozzle can be moved in rotation about the longitudinal axis of the segment of the spray lance that faces the spray nozzle, i) a fifth joint via which the spray nozzle can be moved in such a way that the outlet opening of the spray nozzle can be brought close to or away from the longitudinal axis of the segment of the spray lance that faces the spray nozzle, a first control device k), with which the movements of the spray lance can be directed via the first, second, and third joints, and a second control device l), with which the movements of the spray nozzle can be directed via the fourth and fifth joints, and wherein the first control device and the second control device can each be operated manually, without computer assistance, with the aid of two joysticks, one joystick belonging exclusively to the first control device and the other joystick belonging exclusively to the second control device: or wherein the first control device is computer-operated and the second control device can be operated manually, without computer assistance, with the aid of a joystick.

2. An apparatus according to claim 1, wherein the carrier is arranged on a mobile chassis.

3. The apparatus according to claim 1, wherein the segment of the spray lance that faces the spray nozzle is a telescopic arm.

4. The apparatus according to claim 1, wherein a segment of the spray lance that faces away from the spray nozzle can be extended in the direction of the spray nozzle so that by means of appropriate extension and retraction, the distance between the carrier and the spray nozzle can be varied, such that, during operation, the segment of the spray lance that faces away from the spray nozzle is fixed in an extended position and, during transport and parking, the segment of the spray lance that faces away from the spray nozzle is fixed in a correspondingly retracted position, in which the distance between the carrier and the spray nozzle is relatively small.

5. A vehicle having an apparatus according to any one of claims 1 or 2 to 4.

6. A method of coating an inner surface of a tunnel section with sprayed concrete with the aid of an apparatus according to any one of claims 1 or 2 to 4, wherein the spray nozzle is kept at a distance of 1 to 3 m at right angles to the inner surface of the tunnel section during spraying.

7. A process for the production of coatings in tunnel or mine construction using the apparatus according to any one of claims 1 or 2 to 4.

* * * * *